US009536414B2

(12) United States Patent
MacNeille

(10) Patent No.: US 9,536,414 B2
(45) Date of Patent: Jan. 3, 2017

(54) VEHICLE WITH TACTILE INFORMATION DELIVERY SYSTEM

(75) Inventor: Perry R. MacNeille, Lathrup Village, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 1130 days.

(21) Appl. No.: 13/306,024

(22) Filed: Nov. 29, 2011

(65) Prior Publication Data

US 2013/0135201 A1 May 30, 2013

(51) Int. Cl.
*G08B 21/06* (2006.01)

(52) U.S. Cl.
CPC ..... *G08B 21/06* (2013.01)

(58) Field of Classification Search
CPC ..... G08B 21/06
USPC ..... 345/157, 175
See application file for complete search history.

(56) References Cited

U.S. PATENT DOCUMENTS

| | | | | |
|---|---|---|---|---|
| 6,430,450 | B1 * | 8/2002 | Bach-y-Rita et al. | 607/134 |
| 7,071,844 | B1 * | 7/2006 | Moise | 341/21 |
| 2006/0161218 | A1 * | 7/2006 | Danilov | 607/45 |
| 2008/0009772 | A1 | 1/2008 | Tyler et al. | |
| 2008/0122799 | A1 * | 5/2008 | Pryor | 345/173 |
| 2009/0144622 | A1 * | 6/2009 | Evans et al. | 715/706 |
| 2009/0312817 | A1 | 12/2009 | Hogle et al. | |
| 2009/0326604 | A1 | 12/2009 | Tyler et al. | |
| 2011/0287392 | A1 * | 11/2011 | Al-Tawil | A61F 4/00 434/112 |
| 2012/0123225 | A1 * | 5/2012 | Al-Tawil | A61B 5/228 600/301 |
| 2012/0268370 | A1 * | 10/2012 | Al-Tawil | A61F 4/00 345/157 |
| 2016/0250054 | A1 * | 9/2016 | Al-Tawil | A61F 4/00 |

OTHER PUBLICATIONS

Howstuffworks "How BrainPort Works" [online], 2010 [retrieved Sep. 17, 2010]. Retrieved from the Internet: <URL: http://science.howstuffworks.com/brainport.htm/printable, pp. 1-5.
Daniel Kelly, et al., A Tongue Based Input Device, pp. 1-8.
T. Scott Saponas, et al., Optically Sensing Tongue Gestures for Computer Input, 2009, pp. 1-4.
Nicholas J. Droessler, et al., Tongue-Based Electrotactile Feedback to Perceive Objects Grasped by a Robotic Manipulator: Preliminary Results, pp. 1-5.

* cited by examiner

*Primary Examiner* — Tony Davis
(74) *Attorney, Agent, or Firm* — Frank MacKenzie; MacMillan, Sobanski & Todd, LLC

(57) ABSTRACT

A device for delivering stimuli to a user of a vehicle includes a data generating device that generates signals regarding information regarding a vehicle or surroundings about the vehicle. A human interface device is provided for positioning in contact with a user of the vehicle. The human interface device receives the signals from the data generating device. A control is operable to select the signals from the data generating device for operating the human interface device to deliver stimuli to the user of the vehicle.

6 Claims, 5 Drawing Sheets

VEHICLE WITH TACTILE INFORMATION DELIVERY SYSTEM

BACKGROUND OF THE INVENTION

This invention relates in general to information systems that provide sensory inputs to a driver or other occupant of a vehicle. In particular, this invention relates to an improved vehicle information system that includes a device for delivering tactile stimuli to a vehicle user.

Vehicle operators, particularly automobile operators, receive numerous sensory inputs while operating the vehicle. Most of such sensory inputs are visual in nature, which means that the eyes of the operator of the vehicle are diverted from the road in which the vehicle is traveling in order to receive them. Some of such sensory inputs relate directly to the operation of the vehicle, such as a standard variety of gauges and indicators that are provided on a dash panel. Others of such sensory inputs related to occupant entertainment or comfort, such as media, climate, and communication controls. It is generally believed that the risk of a hazard arising is increased each time the eyes of the operator of the vehicle are diverted from the road in which the vehicle is traveling.

Some vehicle information systems have been designed to minimize the amount by which the eyes of the operator of the vehicle are diverted from the road in which the vehicle is traveling. For example, it is known to locate the most relevant vehicle information near the normal viewing direction of the operator so that the amount by which the eyes of the operator of the vehicle are diverted from the road in which the vehicle is traveling is minimized. It is also known to project some of such vehicle information on the windshield, again to minimize the amount by which the eyes of the operator of the vehicle are diverted from the road. Notwithstanding these efforts, it would be desirable to provide an improved vehicle information system that includes minimizes or eliminates the visual nature of the sensory inputs.

SUMMARY OF THE INVENTION

This invention relates to an improved device for delivering stimuli to a user of a vehicle. The device includes a data generating device that generates signals regarding information regarding a vehicle or surroundings about the vehicle. A human interface device is provided for positioning in contact with a user of the vehicle. The human interface device receives the signals from the data generating device. A control is operable to select the signals from the data generating device for operating the human interface device to deliver stimuli to the user of the vehicle.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
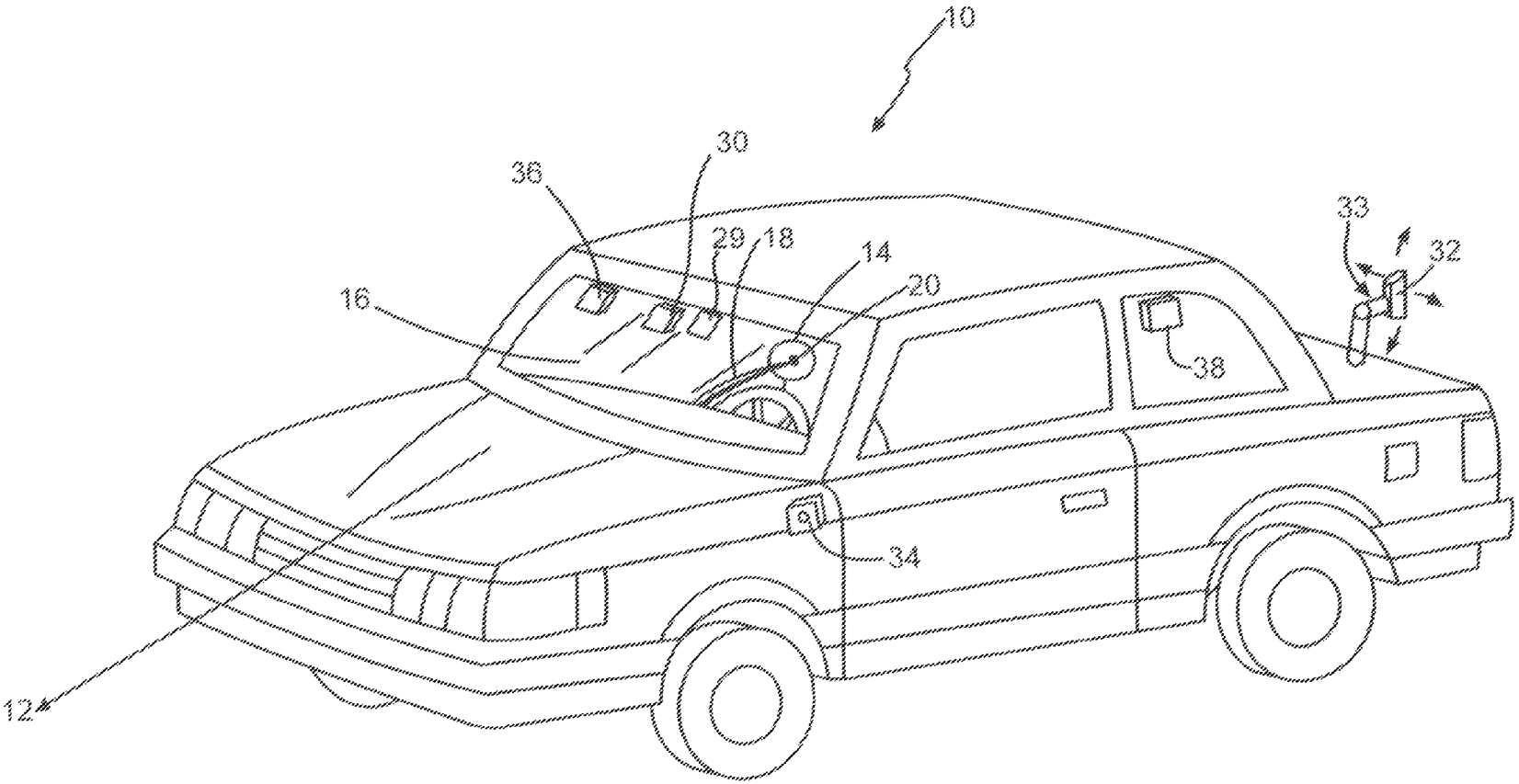
FIG. 1 is perspective view of an automotive vehicle that includes an improved vehicle information system in accordance with this invention.

Referring to the drawings, there is illustrated in FIG. 1 an automotive vehicle 10 that includes an improved vehicle information system in accordance with this invention. The vehicle 10 is equipped with a variety of data generating devices that gather and disseminate data concerning the vehicle 10 and its surroundings. As will be explained in greater detail below, these data generating devices can include cameras, instrument gauges, text displays, switches, and the like. The data generating devices communicate with a human interface device 20, which is in physical contact with a driver 14 or other occupant of the vehicle in the manner described below. The illustrated human interface device 20 is connected to the data generating devices through a communication device, such as a conventional wire 18 or a wireless electronic link (not shown).

The vehicle 10 includes a front windshield 16 that faces in a forward direction 12 and a rear windshield 17 (see FIG. 3) that faces in a rearward direction 12. The vehicle 10 is also equipped with several cameras, some or all of which may be embodied as electronic digital cameras. A first camera 30 is positioned adjacent a rear view mirror 29 and is aimed in a rearward direction that is opposite to the forward direction 12. Thus, the field of view of the first camera 30 is through the rear windshield 17. Thus, the first camera 30 may either be used in conjunction with the rear view mirror 29 or lieu thereof. A second camera 32 is mounted on a rear portion or trunk of the vehicle 10. The second camera 32 may be supported for movement relative to the vehicle 10, such as side to side movement and up and down movement as indicated by the arrows in FIG. 1. To accomplish this, one or more supporting structures and/or motors 33 may be used to support and move the second camera 32 as desired. The second camera 32 may additionally (or alternatively) be used as part of an obstacle sensing system (not shown) or as a supplement to (or in lieu of) the rear view mirror 29 and/or the first camera 30.

Figure 2:
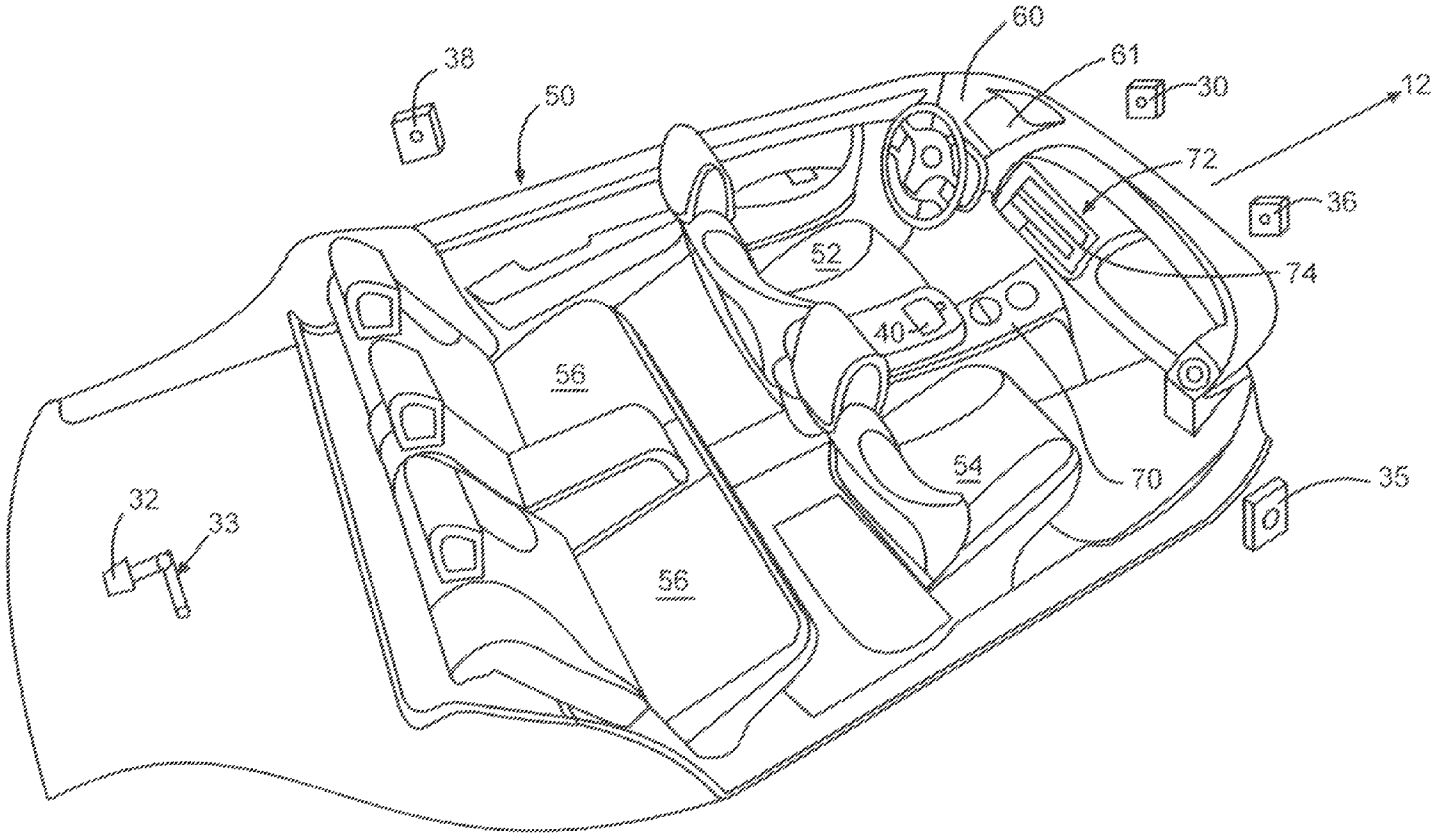
FIG. 2 is a perspective view of an interior of the automotive vehicle illustrated in FIG. 1.
Figure 3:
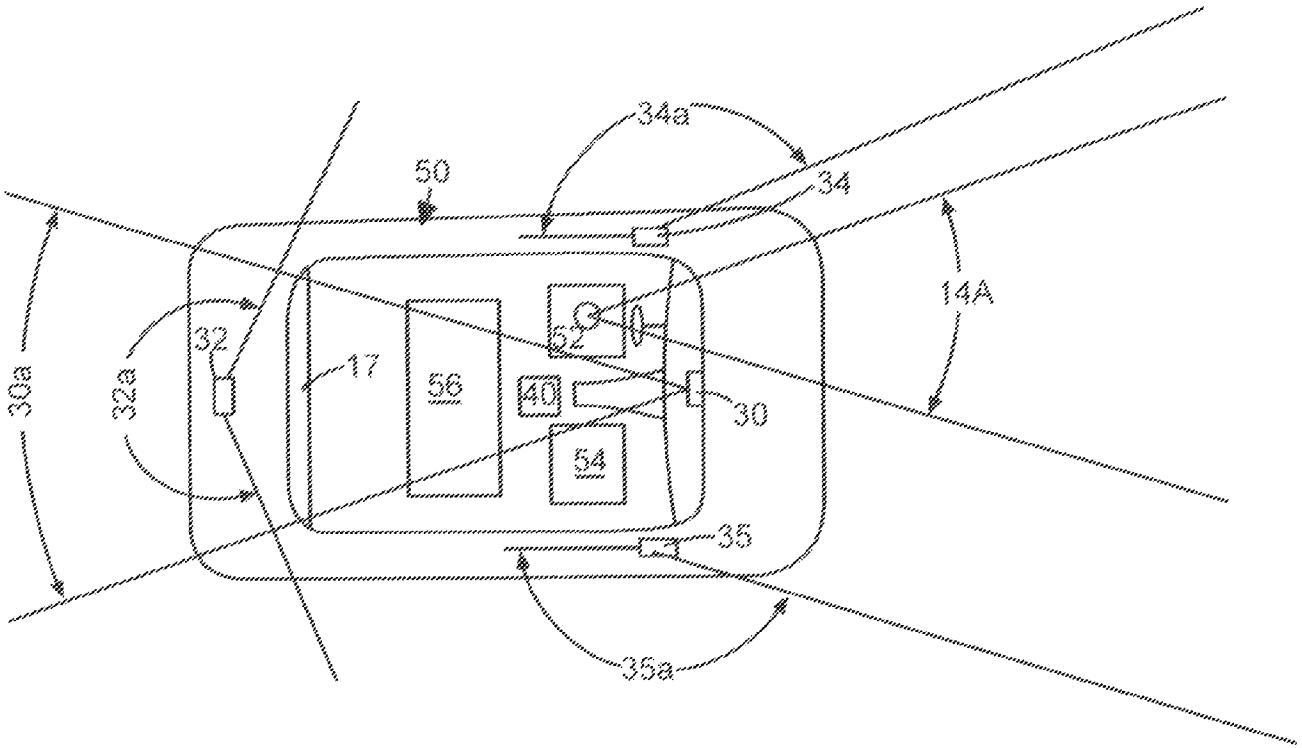
FIG. 3 is a plan view of the interior of the automotive vehicle illustrated in FIGS. 1 and 2.

A third camera 34 may be mounted on a left side of the vehicle, either in a fixed manner or for movement relative to the vehicle 10 as described above. Similarly, as shown in FIGS. 2 and 3, a fourth camera 35 may be mounted on a right side of the vehicle, either in a fixed manner or for movement relative to the vehicle 10 as described above. The third and fourth cameras 34 and 35 may be located on the exterior of the vehicle 10 as shown, or alternatively within the interior thereof as shown in phantom at 34' and 35' in FIG. 4).

As best shown in FIG. 2, the vehicle 10 may further include an interior 50 having a fifth camera 36 that is aimed toward a front passenger seat 54 and a sixth camera 38 that is aimed toward a rear passenger seat 56. The fifth and sixth cameras 36 and 38 are intended to monitor activity in the associated passenger seats 54 and 56 and are particularly useful when such passenger seats 54 and 56 are occupied by infant and child passengers.

Figure 4:
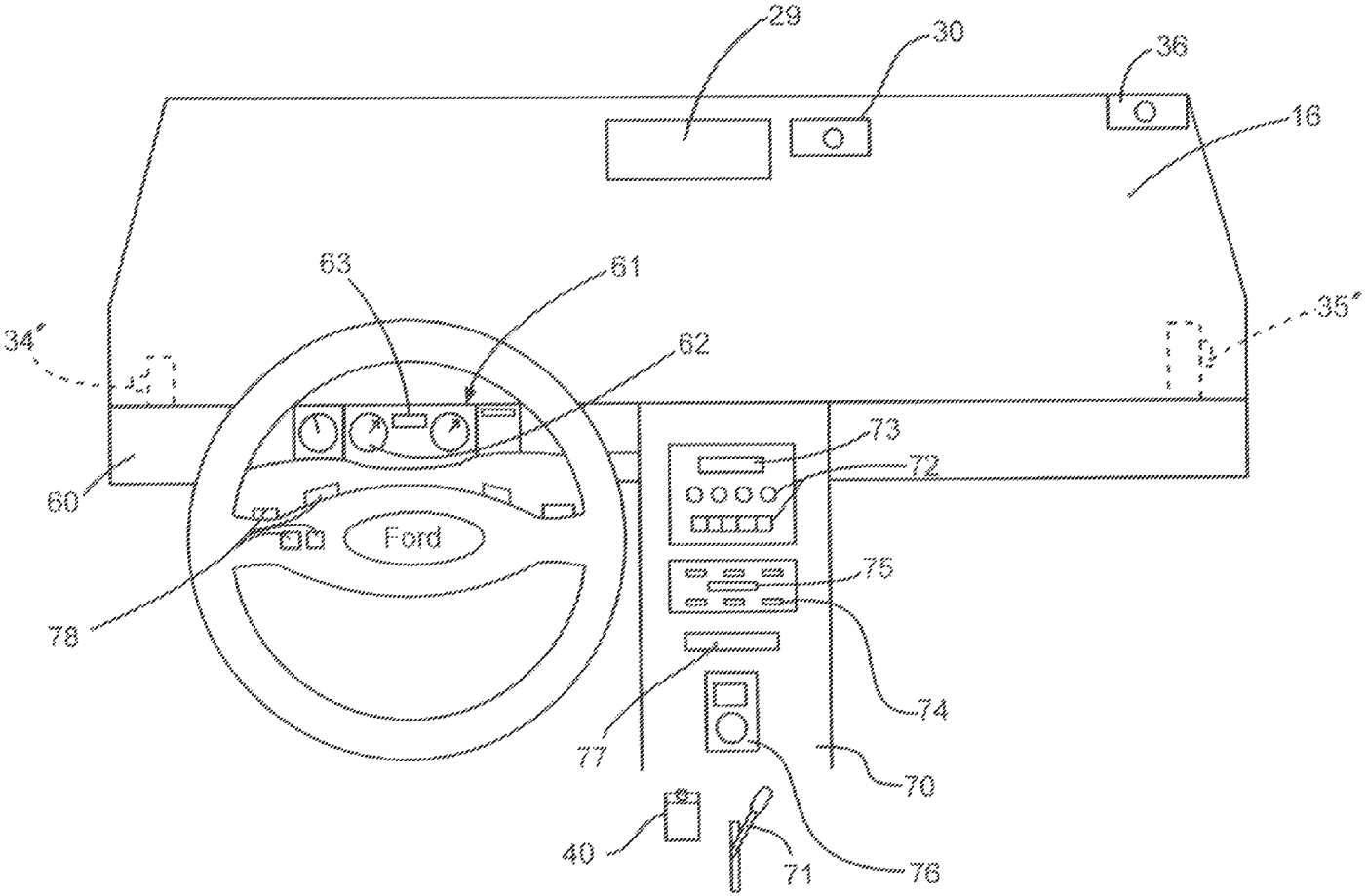
FIG. 4 is an elevational view of a dashboard in the interior of the automotive vehicle illustrated in FIGS. 1, 2, and 3.

The vehicle 10 may also include a conventional dashboard 60 (see FIGS. 2 and 4) having an instrument cluster 61. The instrument cluster 61 is preferably located in a sightline with a person who is occupying a driver seat 52. As best shown in FIG. 4, the illustrated instrument cluster 61 includes a variety of computer-based digital indicators and gauges 62 (such as speed, fuel, and water temperature gauges, etc.) as well as various switches and displays 63 (such as light switches, text message displays, etc.).

The vehicle 10 may also include a center console 70 that is located between the driver seat 52 and the passenger seat 54. The center console 70 may extend into the dashboard 60, and either or both of the dashboard 60 and the center console 70 may include comfort controls 72 and displays 73 (for such as for heating, air conditioning, seat heating and/or cooling, etc.) and entertainment controls 74 and displays 75 (such as for radios, CD players, etc.). Controls may include conventional touch screens, such as that used in a SYNC® system available from Ford Motor Company. Docking stations for entertainment devices, such as for a portable music player 76 or a cell phone 77 may also be mounted on the dashboard 60 and/or the center console 70.

A seventh camera 40 may be mounted on or near the center console 70. However, the seventh camera 40 may be positioned at any other desired location in or on the vehicle 10 where a sightline to the instrument cluster 61 exists. Alternatively, the seventh camera 40 may also be used to identify an operative position of a gearshift lever 71 that is provided on or near the center console 70. As will be suggested below, the seventh camera 40 may be supplemented or replaced by direct input from the vehicle instrumentation and gauges to the human interface device 20.

Referring to FIG. 3, it is preferable that a person occupying the driver seat 52 (such as the driver 14) maintain his or her visual focus in the area toward which the vehicle is moving, which is normally in the forward direction 12. A preferred angle of vision 14*a* for the person occupying the driver seat 52 is about ten degrees. To assist in peripheral vision outside of that preferred angle of vision 14*a*, the third and fourth cameras 34 and 35 are preferably directed toward areas on the opposite sides of the vehicle 10 that range through respective angles 34*a* and 35*a* of approximately one-hundred seventy-five degrees. It may be advisable in certain instances that the third and fourth cameras 34 and 35 be movable to cover the preferred range.

The first camera 30 is preferably focused on an area through the rear windshield 17 having an angular range 30*a* of about ten degrees, similar to that of the rear view mirror 29. Similarly, the second camera 32 may have a range of motion to cover an angular range 32*a* of one-hundred eighty degrees or greater to assist in viewing blind spots. It should be noted that none of the cameras are intended to replace or supplement the driver's main line of vision 14*a*, as critical driver information is best delivered visually in the usual manner.

Figure 5:
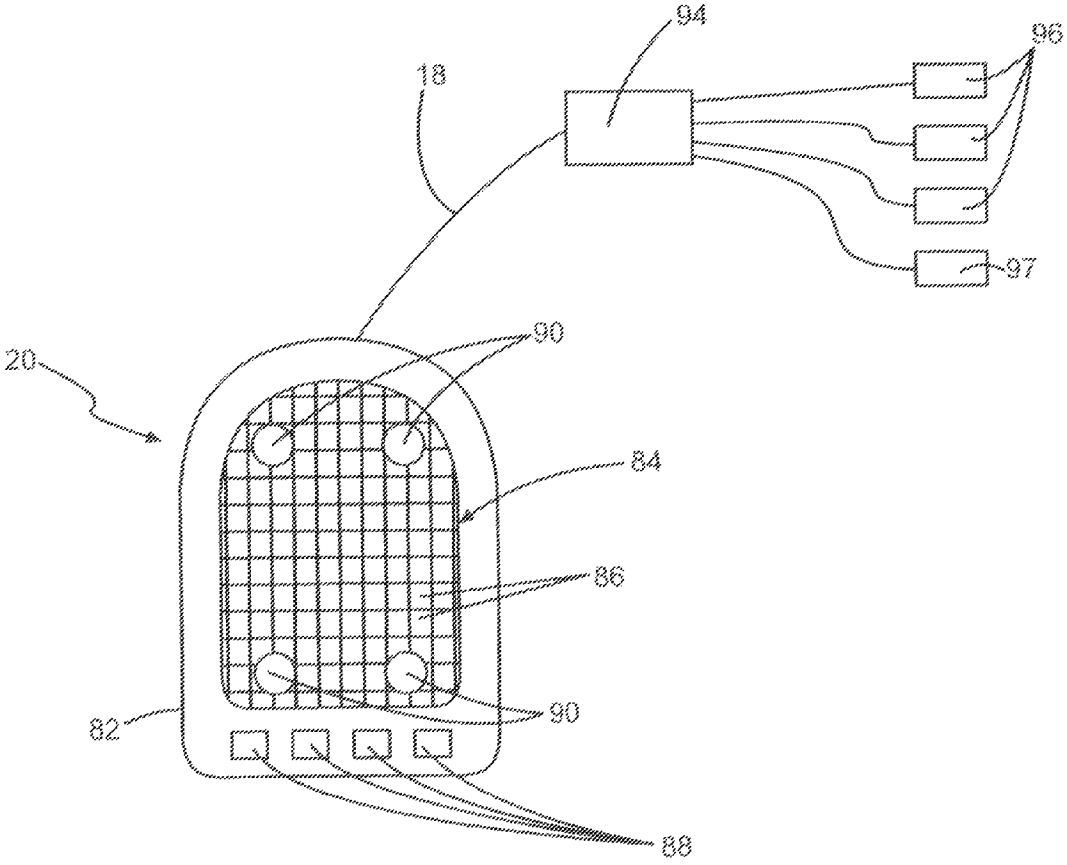
FIG. 5 is a schematic view of the vehicle information system of this invention.

Referring to FIG. 5, the human interface device 20 is illustrated as a tactile tongue imager that includes a mouthpiece 82 that can be positioned in the mouth of a vehicle occupant, preferably the driver 14, in contact with the tongue. The human interface device 20 provides information to the tongue in the form of sensory electrical or pressure stimulation. The human interface device 20 receives information from the various data generating devices disclosed herein, including all of the cameras, instrument gauges, displays, etc. (which are generally indicated at 96 in FIG. 5) through the wire 18. As mentioned above, the wire 18 can be replaced by a wireless electronic link (not shown). In such an instance, the human interface device 20 would preferably be powered by a battery or other internal power source.

Information from the various data generating devices 96 is fed to a processor 94, which encodes and transmits the information to a transducer pixel array 84 of a plurality of electrodes 86 provided on the mouthpiece 82. A vehicle system network 97 may also be connected to the processor 94 to receive information from the other devices (not shown) provided within the vehicle 10, such as sensors, computers, the instrument cluster 61, the SYNC® system, heating and air conditioning, controls, signal lights, etc. Mobile devices, such as cell phones, may be connected through a hard-wire or wireless connection with the processor 94, and mobile device screens may be displayed on the human interface device 20 using virtual network computing or other methods.

The electrical impulses sent by the processor 94 are representative of an image or pattern that can be expressed on the human interface device 20. The transducer pixel array 84 expresses the image or pattern in the form of electrical or pressure impulses or vibrations on the tongue or other surface on the driver 14. The optical lobe of the brain of the driver 14 can be trained to process the impulses or vibrations on the tongue or other surface on the driver 14 in a manner that is comparable to the manner in which the brain processes signals from the eyes, thus producing a tactile "image" that is similar to that which may be produced from the eyes of the driver 14. The brain of the driver 14 can learn to "view" or interpret signals from both the eyes and tongue simultaneously so as to effective "view" two "images" simultaneously.

The human interface device 20 may additionally includes one or more sensors 88 that can detect characteristics of the driver 14. For example, one of such sensors 88 may monitor the body temperature of the driver 14. The sensors 88 may also include micro-electromechanical systems and nano-electromechanical system technology sensors that can measure saliva quantity and chemistry, such as the concentration of inorganic compounds, organic compounds, proteins, peptides, hormones, etc. The sensors 88 may also include MEMS accelerometers or gyroscopes that can measure one or more characteristics of the driver 14, such head orientation or position, gaze detection, etc. These data can be used to detect when the human interface device 20 is being used by the driver 14 to activate the operation of the human interface device 20. Such data may also be used to judge other characteristics of the driver 14 such as wellness, fatigue, emotional state, etc. This information can trigger audio or visual messages to the driver 14, either through the human interface device 20 or otherwise, or cause other actions, including disabling the vehicle.

The transducer pixel array 84 is adapted to provide a control using pixels to allow human feedback through the tongue. Four feedback pixel areas 90 are positioned generally at the four corner areas of the transducer pixel array 84. The driver 14 may select one or more of the feedback pixels areas 90 by applying pressure with the tongue. The feedback pixels areas 90 may be used to select data, such as one or more of the data generating devices (cameras, displays, etc.) which will provide data to the mouthpiece 82 of the human interface device 20. For example, the feedback pixel areas 90 may be used to select whether to receive data from the sixth camera 38 or from a radio display (not shown). The feedback pixel areas 90 may also be used as buttons to select one of four icons related to a particular data generating device. Alternatively, the four feedback pixel areas 90 may be used as up, down, and side-to-side arrows to operate a mouse, pointer, or joystick (not shown) that can be used to select an icon or an item from a group of icons on a menu, a touch screen, and the like. Tactile pressure on the tongue allows the driver 14 to feel buttons being pushed on the image, or to feel mouse over events, etc.

Referring back to FIG. 4, one or more control buttons 78 may be provided in the interior 50 of the vehicle 10. The control buttons 78 may be manually manipulated by the driver 14 to select which one of a plurality of the data generating devices (cameras, gauges, displays, comfort and entertainment devices and controls, etc.) is to communicate with the human interface device 20 at any given point in time. If the control buttons 78 are adapted to be operated by hand, it is preferable that they be provided in a convenient location (such as on a steering wheel as shown) so that the driver 14 may operate them without losing visual sight of the road. Alternatively, the human interface device 20 may be used in lieu of the control buttons 78 to select the desired one or more of the various data generating devices.

Feedback may used to aim any or all of the cameras described above so as to such cameras to pan across a display or displays, such as the entertainment displays or to dial a cell phone. Feedback also allows a user to enable heads-up displays, including 3D displays to be sensed through the human interface device 20, or to bring a cell phone image or other image closer to the road viewing area. Feedback may also be used to call for help, to enter codes to start or disable the vehicle, etc. Feedback may further be in the form of a gesture recognition system. For example, head gestures or motions can be used as commands such that a camera driving the display can be aimed at a touch screen so that the driver 14 can control the touch screen without diverting his or her eyes from the road. Position sensors can also power virtual reality, three dimensional displays, such as can be used in a heads-up display.

In addition to the feedback pixel areas 90, the transducer pixel array 84 can be used to recognize speech and thereby to operate controls with speech. The transducer pixel array 84 is positioned between the tongue and roof of the mouth such that the transducer pixel array 84 may detect patterns of pressure thereon that measure pressure of the tongue on the roof of the mouth. Speech commands may therefore be used in addition to or in place of commands send through the feedback pixel areas 90.

In summary, the present invention will allow the driver 14 to "see" two "images" simultaneously, one by means his or her eyes and the other by means of his or her tongue. This will allow the driver 14 to keep his or her eyes on the road while assimilating other information concerning the vehicle 10 and its surroundings.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A combined vehicle and device for delivering tactile stimuli to a user of the vehicle comprising:

a vehicle;

a data generating device that generates signals representative of information regarding the vehicle or surroundings about the vehicle;

a human interface device having a first surface for positioning in contact with a tongue of a user of the vehicle and that receives the signals from the data generating device, the human interface device providing tactile stimuli to the tongue of the user of the vehicle from the first surface; and a control on the first surface of the human interface device operable by the tongue of the user of the vehicle to select the signals from the data generating device for operating the human interface device to deliver tactile stimuli to the tongue of the user of the vehicle.

2. A device as defined in claim 1 wherein a sensor activates the human interface device when a presence of the user of the vehicle is detected.

3. A device as defined in claim 1 wherein the control is speech-operable.

4. A device as defined in claim 1 wherein the control provides for movement of a cursor among a plurality of icons.

5. A device as defined in claim 1 wherein the control is a tongue-operable, four-corner control.

6. A device as defined in claim 1 wherein the data generating device is a display selection control device.

* * * * *